US012378653B2

(12) United States Patent
Cloutot et al.

(10) Patent No.: US 12,378,653 B2
(45) Date of Patent: Aug. 5, 2025

(54) INSTALLATION FOR COATING A LONGITUDINALLY-RUNNING STRIP-SHAPED METAL PRODUCT

(71) Applicant: Clecim SAS, Savigneux (FR)

(72) Inventors: Laurent Cloutot, Killwangen (CH); Lionel Goiset, Montbrison (FR); Benjamin Grenier, Saint-Paul-en-Jarez (FR)

(73) Assignee: Clecim SAS, Savigneux (FR)

( * ) Notice: Subject to any disclaimer, the term of this patent is extended or adjusted under 35 U.S.C. 154(b) by 264 days.

(21) Appl. No.: 17/924,757

(22) PCT Filed: Mar. 24, 2021

(86) PCT No.: PCT/EP2021/057607
§ 371 (c)(1),
(2) Date: Nov. 11, 2022

(87) PCT Pub. No.: WO2021/228461
PCT Pub. Date: Nov. 18, 2021

(65) Prior Publication Data

US 2023/0193444 A1 Jun. 22, 2023

(30) Foreign Application Priority Data

May 12, 2020 (EP) ..... 20290042

(51) Int. Cl.
*C23C 2/20* (2006.01)
*C23C 2/00* (2006.01)
(Continued)

(52) U.S. Cl.
CPC ..... *C23C 2/20* (2013.01); *C23C 2/00344* (2022.08); *C23C 2/14* (2013.01); *C23C 2/16* (2013.01);
(Continued)

(58) Field of Classification Search
CPC .. C23C 2/003; C23C 2/18; C23C 2/20; C23C 2/524
See application file for complete search history.

(56) References Cited

U.S. PATENT DOCUMENTS 3,589,330 A * 6/1971 Alexeff ..... D06B 9/00 118/421
4,655,166 A * 4/1987 Nishimura ..... C21D 9/56 118/63
(Continued)

FOREIGN PATENT DOCUMENTS

CN 105518176 A 4/2016
CN 108040486 A 5/2018
(Continued)

*Primary Examiner* — Karl Kurple
(74) *Attorney, Agent, or Firm* — Laurence A. Greenberg; Werner H. Stemer; Ralph E. Locher

(57) ABSTRACT

An installation for coating a longitudinally-running, strip-shaped metal product includes a tank containing a coating in liquid form, into which the metal product is dipped, a wiping system disposed at a vertical outlet of the product from the tank and intended to wipe each face of the strip-shaped product, at least one ancillary device disposed at an outlet of the product from the wiping system in a manner facing one of the faces of the product, and a holding device holding the wiping system and the ancillary device. The holding device includes a securing unit forming a common lateral support for the wiping system and each ancillary device by using multiple securing points.

15 Claims, 3 Drawing Sheets

(51) Int. Cl.

| | |
|---|---|
| ***C23C 2/14*** | (2006.01) |
| ***C23C 2/16*** | (2006.01) |
| ***C23C 2/18*** | (2006.01) |
| ***C23C 2/24*** | (2006.01) |

(52) U.S. Cl.
CPC ..... *C23C 2/18* (2013.01); *C23C 2/24* (2013.01); *C23C 2/522* (2022.08); *C23C 2/524* (2022.08); *C23C 2/5245* (2022.08)

(56) References Cited

U.S. PATENT DOCUMENTS

| | | | | |
|---|---|---|---|---|
| 9,080,232 | B2 * | 7/2015 | Ohara | C23C 2/20 |
| 9,371,884 | B2 * | 6/2016 | Ohara | C23C 2/40 |
| 10,190,203 | B2 | 1/2019 | Fontaine et al. | |
| 11,549,168 | B2 | 1/2023 | Fontaine et al. | |
| 2008/0044584 | A1 * | 2/2008 | Eriksson | C23C 2/00344 427/430.1 |
| 2016/0122854 | A1 | 5/2016 | Schwander et al. | |
| 2017/0094326 | A1 | 3/2017 | Arimilli et al. | |
| 2017/0268092 | A1 * | 9/2017 | Fontaine | B05C 3/02 |
| 2017/0283929 | A1 * | 10/2017 | Fontaine | C23C 2/526 |
| 2018/0155814 | A1 * | 6/2018 | Fontaine | G01D 5/00 |
| 2018/0363116 | A1 * | 12/2018 | Fontaine | C23C 2/003 |
| 2019/0390315 | A1 * | 12/2019 | Yonekura | C23C 2/52 |
| 2020/0140985 | A1 | 5/2020 | Link et al. | |
| 2021/0189540 | A1 * | 6/2021 | Fontaine | C23C 2/20 |

FOREIGN PATENT DOCUMENTS

| | | | |
|---|---|---|---|
| CN | 110785509 | A | 2/2020 |
| CN | 110809633 | A | 2/2020 |
| DE | 102017109559 | B3 | 7/2018 |
| EP | 1918410 | A2 | 5/2008 |
| EP | 1918410 | A3 | 2/2009 |
| EP | 1784520 | B2 | 5/2017 |
| GB | 786685 | A | 11/1957 |
| SE | 0501338 | L | 12/2006 |
| WO | 2006006911 | A1 | 1/2006 |
| WO | 2006130102 | A1 | 12/2006 |
| WO | 2017036703 | A1 | 3/2017 |

* cited by examiner

INSTALLATION FOR COATING A LONGITUDINALLY-RUNNING STRIP-SHAPED METAL PRODUCT

FIELD AND BACKGROUND OF THE INVENTION

The present invention relates to an installation for coating a longitudinally running metal product of strip type, including a tank containing a coating in liquid form into which the metal product is dipped, a wiping system disposed at a vertical outlet of the product from the tank and dedicated to wiping each face of the strip-type product, at least one ancillary device disposed at an outlet of the product from the wiping system and facing at least one of the faces of the product, and holding means holding the wiping system and the ancillary device.

In the field of metallurgy, a device for coating a running metal product such as a steel strip (1) is well known.

Primarily, the coating is provided in a tank forming a coating bath in the form of liquid metal for example consisting of zinc, magnesium, aluminum or other elements for forming specific alloys. The running strip-type metal product is then dipped into said bath at its liquid metal surface, passes over a bottom roller in the bath and then passes between correcting rollers in order to leave the bath generally vertically to the surface of the bath in order to pass through a wiping system arranged at the outlet of the product from said tank and dedicated to wiping each face of the strip-type product, for example in the form of two air knives arranged transversely (horizontal direction) on either side of the strip while facing each of its faces. Usually, a crossmember for holding the wiping system is arranged at a first height from the upper surface of the liquid coating in the tank. This crossmember is composed in its simplest form of two beams which can be arranged above, to the side or below each of the two air knives in order to hold them at a desired distance and on either side of the faces of the strip during wiping. These beams are secured to the periphery of the tank and are removable in order to be able to remove the complete wiping system, for example during a maintenance or strip change operation.

Downstream of the wiping system, it is also possible to arrange a device, such as a device for stabilizing the coated metal product, in order to ensure that said product is held more stably and more precisely between the two air knives. For this purpose, this stabilizing device can be held in various ways, such as, for example:

- WO2006006911A1 (granted under EP1784520B2) provides that the wiping system is secured to the crossmember and that the stabilizing device is arranged in the crossmember and has a fixed connection to the wiping system.
- WO2017036703A1 provides that:
  - the blowing system is suspended on the crossmember;
  - the stabilizing device is, on the one hand, arranged between the crossmember and the wiping system and, on the other hand, said stabilizing device is suspended on the crossmember by a means for holding to the crossmember that is independent of the wiping system.
- US20170094326A1 (FIG. 15) finally provides that the wiping system is suspended on the crossmember and the stabilizing device (comprising movable electromagnets) is sandwiched between the wiping system and the crossmember.

Other devices apart from a stabilizing device are also provided in this type of coating installation, for example a device comprising distance sensors arranged on the wiping system, the stabilizing device or the crossmember, said sensors making it possible to measure a horizontal position of the running strip with respect to a reference position.

All these coating installation configurations thus have very static geometries dimensioned for conventional types of products and coatings. However, with the coating technologies changing over time, there is an ever greater requirement to be able to dynamically adapt the geometry of these coating installation configurations.

Specifically, depending on the mechanical and chemical properties of the product to be coated, on the coating used, on the coating method and on the coating quality tolerances to be ensured by specific measurements (strip distance, coating thickness, coating composition, temperature, pressure, analysis and regulation of atmosphere, etc.), there is an ever greater requirement to be able to add, interchange or otherwise save on devices ancillary to the wiping system: thus, the configurations with very static geometry presented above do not make it possible, or do not make it possible without a high degree of complexity, to ensure the flexibility of adding, interchanging or eliminating specific devices.

Finally, it should be noted that the aforementioned coating installations require specific maintenance steps for each of their components (wiping system, stabilizing devices, measurement sensors, etc.). By virtue of their integrated configuration, it is then necessary to remove the whole of the installation on either side of the strip, for example by means of a bridge crane in order to move it out of the surface of the bath. This type of maneuver is thus very constraining if the maintenance operation is minor (change or addition of a sensor, for example), since it means that the production of the coated product has to be stopped in a very costly manner.

SUMMARY OF THE INVENTION

An aim of the present invention is to propose an installation for coating a running metal product that is provided with at least one wiping system and with at least one ancillary device making it possible to solve the aforementioned problems, in particular to promote a modular geometric reconfiguration and a simple maintenance of said wiping and ancillary devices system.

There is thus proposed an installation for coating a running metal product of the strip type having the features described below.

On the basis of an installation for coating a longitudinally running metal product of the strip type, comprising:

- a tank containing said coating in liquid form into which the metal product is dipped;
- a wiping system arranged at the vertical outlet of the product from said tank and dedicated to wiping each face of the strip-type product,
- at least one device ancillary to said wiping system (for example an electromagnetic strip-stabilizing device) arranged at the outlet of the product from the wiping system and facing at least one of the faces of the product;
- a holding means holding the wiping system and the ancillary device above the tank;

the invention provides that the holding means comprises a securing unit forming a common lateral support for the wiping system and each ancillary device by means of multiple securing points.

It is understood here that each ancillary device comprises at least one of the following components:

- a strip-stabilizing device;
- a measuring device such as a hot gauge, a distance sensor or a mono- or bidimensional series of such sensors;
- a coating quality control device (spangle control, for example);
- a cooling control device, for example in the form of a controlled-atmosphere confinement box;
- a spray device for minimizing the spangle, for example by means of a spray of alumina powder for a coating of the AZ "aluminum zinc" or AS "aluminum-silicon" type.

Thus, mounting, demounting or an exchange of one of these ancillary devices (or of the wiping system) can be advantageously carried out by detaching only the securing point(s) dedicated to said ancillary device (or to the wiping system). This results, on the one hand, in the maintenance of the installation according to the invention being simplified, since the whole coating installation (apart from the tank) no longer has to be completely removed by a bridge crane, but can be selectively carried out by a forklift on the floor attaching to an ancillary device (or the wiping system) at its securing points in order to remove it, reposition it or replace it in the securing unit forming a common lateral support. On the other hand, depending on the number of multiple securing points arranged on the securing unit, it is possible to add additional ancillary devices according to the requirements to optimize the coating process. Thus, the geometric configuration of the coating installation can easily be made modular.

This simplified maintenance and this increased modularity can thus be optimized by providing that the securing points comprise a removable anchoring means between the securing unit and each ancillary device or the wiping system. Finally, these anchoring means provide a sufficient lateral support (and thus a non-oversized support for reasons of cost and compactness) of each ancillary device and of the wiping system, for example by providing said anchorings of male/female type or of bearing or suspension support type adapted to hold each of the ancillary devices or the wiping system.

Finally, the securing points are provided movably in the securing unit and can thus advantageously have the following features:

- the securing points are independently vertically movable: this makes it possible, on the one hand, to arrange each ancillary device or the wiping system at a desired distance above the tank and, on the other hand, it is possible to arrange each ancillary device or the wiping system at variable relative heights. These two highly advantageous aspects have the consequence that the coating processes according to the product to be coated can be dynamically modified by reconfiguring the geometry of the ancillary devices useful for the coating, in particular at a good height from the tank in order to obtain an optimal technical effect.
- The securing points provide translators and/or movable pivots of 2D or 3D type, with the result that the ancillary devices and/or the wiping system can be dynamically realigned with a format or a variable horizontal positioning of the vertically running strip. Finally, the securing unit can also be movable transversely with respect to the tank in order to compensate for offsets in widths of welded strips succeeding one another as they run continuously at the outlet of the tank.

For this purpose, the installation according to the invention can thus comprise a regulation of the positioning of the securing points with controlled movability, said regulation being governed by an operator or an automatic controller emitting control signals from at least one ancillary measuring device (distance sensor, so-called hot, lukewarm or cold gauge, etc.) to a unit for moving said securing points.

Ideally to ensure the aforementioned advantages, the installation according to the invention provides that the securing unit comprises two lateral elements for supporting the wiping system and at least one ancillary device, each of said lateral elements having the multiple lateral securing points being coupled to at least two lateral ends of the wiping system and of each ancillary device.

A set of subclaims also presents advantages of the invention.

BRIEF DESCRIPTION OF THE FIGURES

Exemplary embodiments and examples of advantageous applications of the invention are provided by way of the described figures.

DETAILED DESCRIPTION OF THE INVENTION

Figure 1:
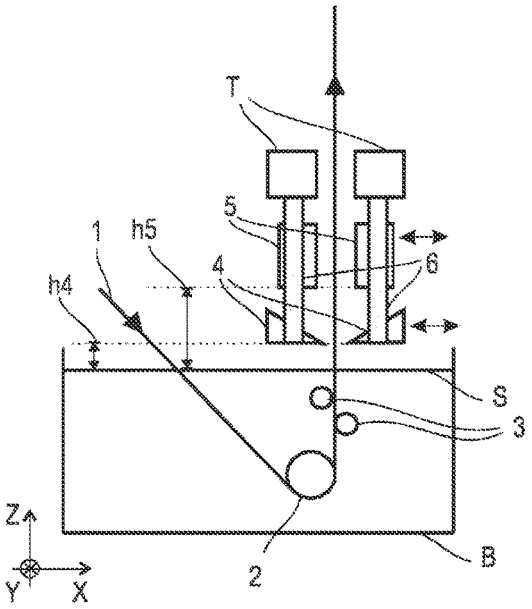
FIG. 1 is an example of an installation for coating a running metal product of the strip type according to the invention, in a side view.
Figure 2:
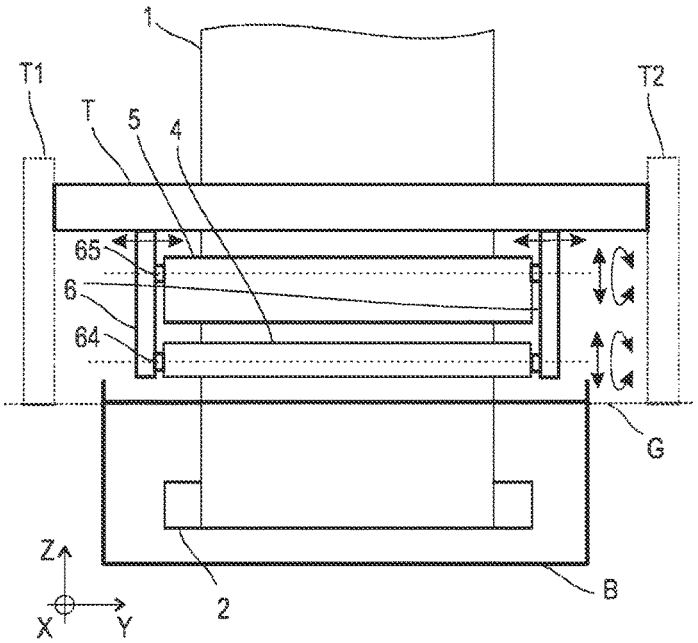
FIG. 2 is an example of the coating installation according to FIG. 1, in a front view.

FIGS. 1 and 2 respectively depict a side view (plane X, Z) and a front view (Y, Z) of an exemplary embodiment of the installation for coating a running metal product (1) of strip type according to the invention.

As known in the prior art, the coating is provided in a tank (B) forming a coating bath in the form of liquid metal for example consisting of zinc, magnesium, aluminum or other elements for forming specific alloys. The running strip-type metal product is then dipped into said bath at its liquid metal surface (S), passes over a bottom roller (2) in the bath and then passes between correcting rollers (3) in order to leave the bath generally vertically (=longitudinal direction Z) to the surface of the bath in order to pass through a wiping system (4) arranged at a first height (h4) from the upper surface of the liquid coating in the tank—that is to say at the outlet of the product from said tank—and dedicated to wiping each face of the strip-type product, for example in the form of two air knives arranged transversely (=horizontal direction Y) on either side of the strip while facing each of its faces. In the case of FIGS. 1 and 2, a crossmember (T) for holding the wiping system is arranged in the upper part of the coating installation. This crossmember is here composed of two beams each arranged above each of the two air knives in order to hold them at a desired horizontal distance from the strip during wiping. These beams are secured to the periphery of the tank, for example by means of lateral pillars (T1, T2) to the side of the tank.

According to this embodiment, the installation for coating a longitudinally (Z) running metal product (1) of the strip type according to the invention thus comprises:

- a tank (B) containing said coating in the form of liquid metal into which the metal product is dipped;
- a wiping system (4) arranged at the vertical outlet (=longitudinal direction Z) of the product from said tank and dedicated to wiping each face of the strip-type product,
- at least one ancillary device (5) arranged at the outlet of the product from the wiping system and facing at least one of the faces of the product;
- a holding means (6, T) holding the wiping system and the ancillary device;
- the holding means comprising a securing unit (6) forming a common lateral support for the wiping system and each ancillary device by means of multiple securing points (64, 65).

The ancillary device (5) is here arranged above the wiping system (4) at a second height (h5) from the surface (S) of the liquid metal bath in the tank. As explained above, the securing points (64, 65) can be provided movably such that the first and the second height (h4, h5) can be flexibly and independently modified according to the parameters required by the coating process, of the type of coating and of the product to be coated. Pivots—here with horizontal axes—can also be provided in order, for example, to vary an orientation of the vertical blowing point from the wiping system toward the vertical running strip. For the same purposes of optimizing the operation of the installation according to the invention, such 2D or 3D pivot means can also be provided so as to ensure degrees of freedom of the wiping system (for example for a correction of horizontal inclination according to an inclined strip profile) but also of the ancillary devices (for example for a correction of inclination of the intended measuring point on a strip).

For the example of the installation according to FIG. 1 or 2 (and of the other described FIGS. 3-7 below), the securing unit (6) more specifically comprises two lateral elements for supporting the wiping system (4) and the ancillary device (5), each of said lateral elements having the multiple lateral securing points (64, 65, 67, 68) being coupled to at least two lateral ends of the wiping system and of each ancillary device (5, 7, 8).

Since the wiping system is the first item of equipment as the strip leaves the tank, it is also possible to provide two securing points (64) formed by a suspended anchoring of said wiping system below each of the lateral elements (6) on either side of the strip.

In the example of the installation according to FIG. 1 or 2, the holding means simply comprises a horizontal crossmember (T) holding the securing unit formed by its two lateral elements (6) for supporting the wiping system (4) and the ancillary device (5). The crossmember (T) is here supported above the tank by two lateral supports in the form of lateral pillars (T1, T2) to the side of the tank. The lateral supports may comprise means for raising the crossmember, but these require a more powerful and costly drive than a plurality of drives dedicated to each positioning of certain securing points (64, 65). For a complete maintenance of the wiping system and of the ancillary device, it is possible to detach the crossmember from its lateral pillars (T1, T2) and then to remove with a bridge crane. However, if a more specific maintenance is only required on one module such as the wiping system (4) or one of the ancillary devices (5), it is advantageously possible to unlock the removable anchorings at the securing points of said module to be maintained and to remove said module without demounting the crossmember and the remaining equipment. Such a removal can ideally take place by a simple forklift, instead of a bridge crane.

Figure 3:
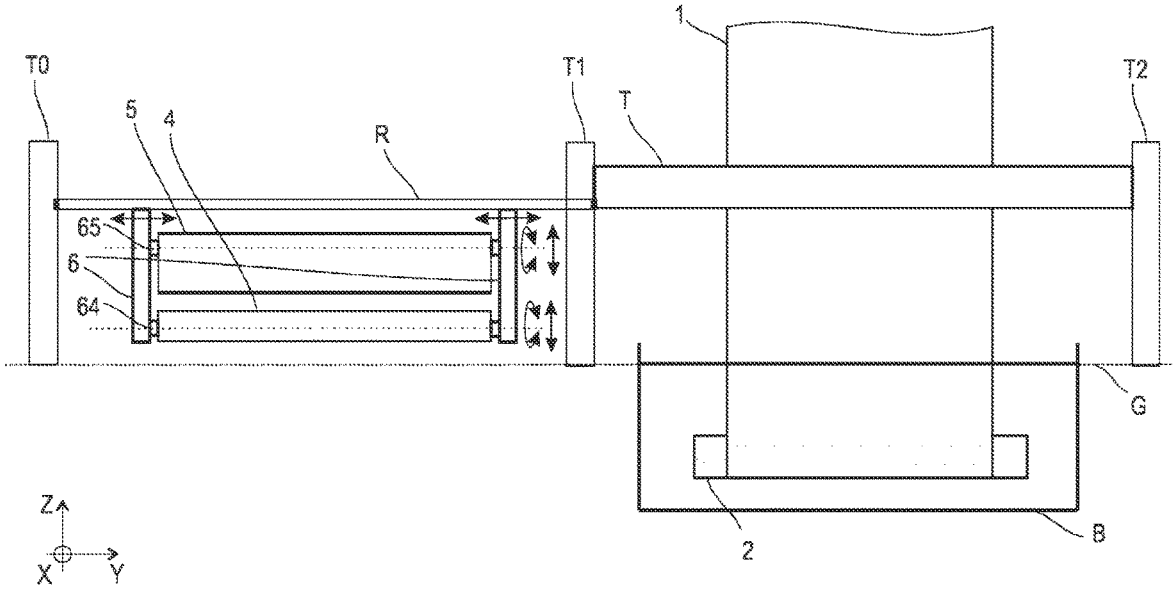
FIG. 3 is a first option of the coating installation according to FIG. 2, in a front view.

FIG. 3 depicts a first option of the coating installation according to FIG. 2, in a front view, in that it comprises a guide support (T0, R) arranged to the side of the tank (B), and to the securing unit (6) in the working position above said tank, in order that said securing unit (6) and the attached wiping system and ancillary device (4, 5) equipment can be retracted horizontally out of the region of the tank. By way of example, the guide support very simply comprises a support pillar (T0) holding a horizontal rail (R) and coupled to a lateral pillar (T1), said rail being arranged at a height dedicated to ensuring sliding of the securing unit (6) holding the attached wiping system and ancillary device (4, 5) equipment from its position below the crossmember (T) toward a parking position outside the region of the tank (B). Thus, a maintenance of the equipment can also be carried out without danger for an operator and without complex lifting means.

Figure 4:
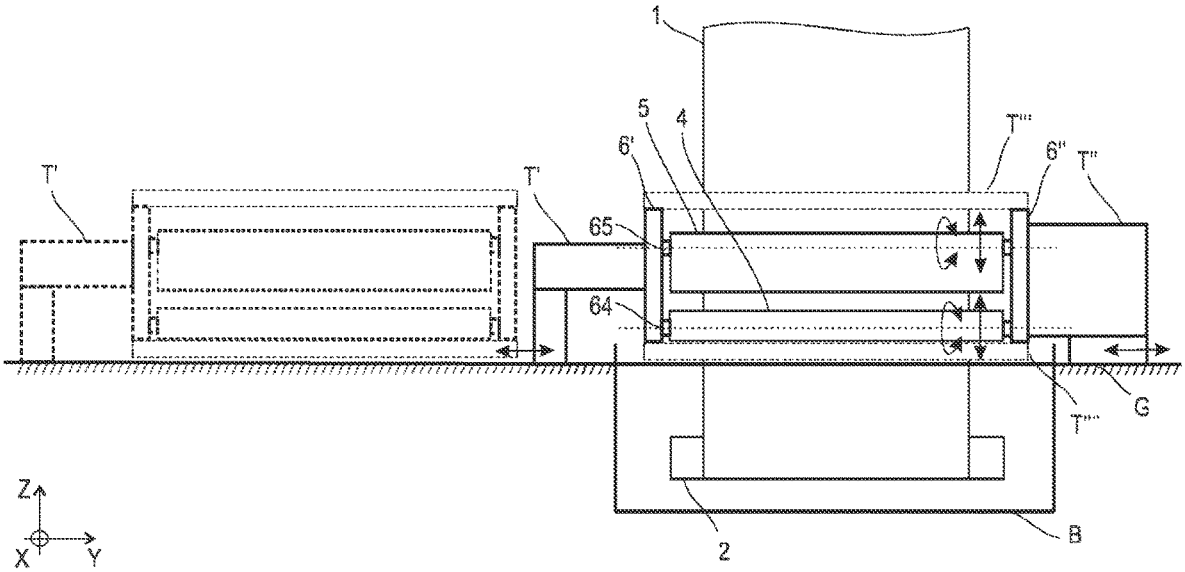
FIG. 4 is a second option of the coating installation according to one of FIGS. 2 to 3, in a front view.

FIG. 4 depicts a second option of the coating installation according to FIGS. 2 and 3, in a front view, in that the installation according to the invention provides that the securing unit (6', 6")—here in the same form as the lateral elements (6) of FIGS. 1 and 2—is supported above the tank by at least one lateral support (T', T") to the side of the tank and placed on the floor (G), either at the very least on one side of the tank or ideally on either side of the tank by means of the two lateral supports (T', T") as shown here. This type of lateral supports makes it possible to save on a relatively bulky crossmember such as the crossmember (T) in FIGS. 1 and 2 or at least two provide one or two such less bulky crossmembers (T'", T"") connected to the upper and/or lower parts of the lateral elements (6', 6") in order to strengthen the securing unit (6', 6"), since, in the operating mode of the coating installation, the lateral elements securing the wiping system (4) and each ancillary device (5) are stably wedged between the two lateral supports (T', T").

Another advantage of this installation according to FIG. 4 lies in the fact that the securing unit (6', 6") can be provided such that it can be retracted to the side of the tank, ideally by means of at least one of the lateral supports (T', T") provided movably to the side of the tank. The movable lateral support (T') can, for example, comprise a horizontal pivot or else, alternatively, a means for translation on the floor as shown in FIG. 4. Here, in FIG. 4, in the right-hand part, the coating installation in active coating operation mode is shown, the lateral elements (6', 6") securing the wiping system (4) and each ancillary device (5) being stably wedged between the two lateral supports (T', T"). In the left-hand part of FIG. 4 and in dotted line, the coating installation in maintenance mode is shown, the lateral elements (6', 6") securing the wiping system (4) and each ancillary device (5) having been offset on the floor (G) by means of the lateral support (T') initially arranged in the vicinity of and to the left of the tank. Here again, it is thus easy to remove the coating installation (apart from the tank) or one of its modules (4, 5) by means of a simple forklift to bring it into a maintenance region.

Figure 5:
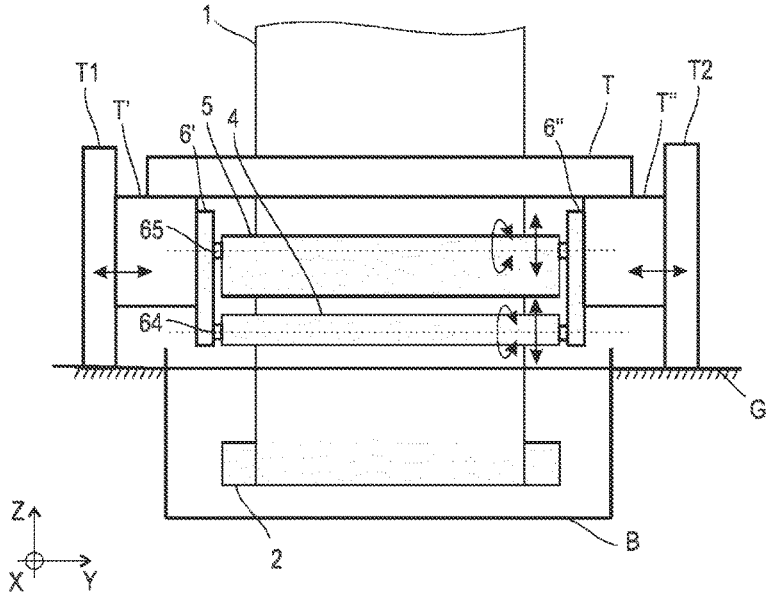
FIG. 5 is a third option of the coating installation according to one of FIGS. 2 to 4, in a front view.

FIG. 5 depicts a third option of the coating installation according to one of FIGS. 2 to 4, in a front view, in that the installation according to the invention provides that the holding means (6', 6")—here in the same form as the two lateral elements (6) of FIGS. 1 and 2 on one side of the strip—is supported above the tank by at least one lateral support (T', T") to the side of the tank, here each of the two said lateral supports (T', T") being themselves coupled by a crossmember (T) according to FIG. 2 in order to make the holding means more rigid (for anti-vibration retention) over the whole width of the tank or at least of the strip. In this sense, the crossmember (T) (or the two beams on each side of the strip faces) and at least the two lateral supports (T', T") can also ideally form a one-piece assembly. Each of the lateral elements of the holding means (6, 6") is fastened laterally to each of the lateral supports (T', T") in a way that is thus also very robust.

Finally, said lateral supports (T', T"), or the one-piece assembly, are held by lateral pillars (T1, T2) arranged in the vicinity of the tank as in FIG. 2, this holding arrangement being able to be movable transversely with respect to the tank in order to compensate for offsets in widths of welded strips succeeding one another while running continuously at the outlet of the tank.

Figure 6:
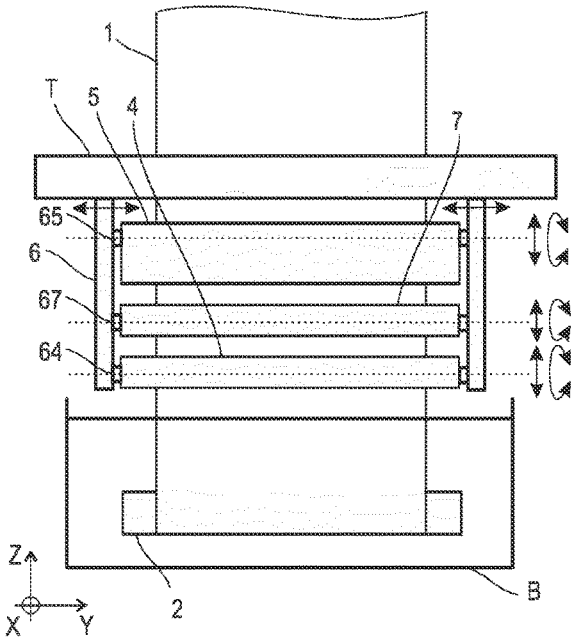
FIG. 6 is a fourth option of the coating installation according to one of FIGS. 2 to 5, in a front view.
Figure 7:
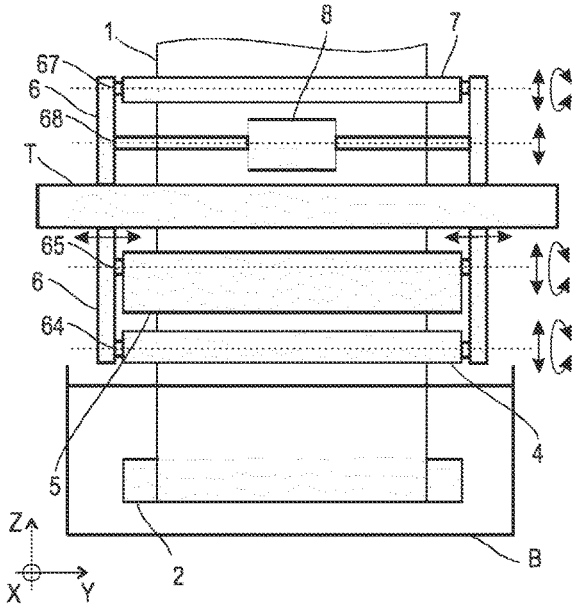
FIG. 7 is a fifth option of the coating installation according to one of FIGS. 2 to 6, in a front view.

FIGS. 6 and 7 respectively depict a fourth and a fifth option of the coating installation according to one of FIGS. 2 to 5 (and 6 for FIG. 7), in a front view, in order to better show the advantageous aspect of increased and flexible modularity of the coating installation according to the invention. Specifically, as described above, the lateral elements (6, 6', 6") form lateral supports to the side of the wiping system (4) and to one or more ancillary devices (5, 7, 8) by simply providing a number (=double the number) of securing points dedicated to each of these modules (4, 5, 7, 8).

By way of example, FIG. 6 thus depicts the fourth option of installation according to the invention comprising lateral elements (6) provided successively, at the vertical outlet of the strip (1) from the tank (B):

- with two lateral securing points (64) for holding the wiping system (4);
- with two lateral securing points (67) for holding the device (7) for measuring the transverse distance of the strip profile;
- with two lateral securing points (65) for holding the electromagnetic strip-stabilizing device (5);
- all the securing points (64, 65, 67) being arranged on the lateral elements (6) held below the crossmember (T) according to FIG. 1 or 2.

Finally, again by way of example, FIG. 7 depicts the fifth option of the installation according to the invention comprising lateral elements (6) provided successively, at the vertical outlet of the strip (1) from the tank (B):

- with two lateral securing points (64) for holding the wiping system (4);
- with two lateral securing points (65) for holding the electromagnetic strip-stabilizing device (5);
- then with the crossmember (T) below which are held the two lateral elements (6) comprising the aforementioned four securing points (64, 65).

Unlike FIG. 6, in FIG. 7, the crossmember (T) also holds two other lateral elements (6) arranged (or extended) above the crossmember, the latter successively comprising:

- two lateral securing points (68) for holding a device for measuring the quality or thickness of the coating by a so-called hot gauge (8);
- two lateral securing points (67) for holding the device (7) for measuring the transverse distance of the strip profile.

The invention claimed is:

1. An installation for coating a metal product, wherein said metal product is longitudinally-running and has a shape of a strip, the installation comprising:

- a tank containing a coating in a liquid form into which the metal product is dipped;
- a wiper disposed at a vertical outlet of the product from said tank, said wiper configured to wipe each face of the metal product;
- at least one ancillary device disposed at an outlet of the metal product from said wiper, said at least one ancillary device facing at least one of the faces of the metal product; and
- a holder holding said wiper and said at least one ancillary device, said holder including a securing unit forming a common lateral support for directly supporting said wiper and each of said at least one ancillary device; said holder includes a horizontal crossmember holding the securing unit;
- said securing unit including lateral elements extending in a vertical direction from the crossmember; a plurality of securing points arranged on the lateral elements of the securing unit; each of said lateral elements having the plurality of securing points being coupled to at least two lateral ends of the wiper and of each said at least one ancillary device;

said ancillary device including at least a strip-stabilizer

- said ancillary device and said wiper each having a height from a surface of the coating in the liquid form in the tank;
- said securing points provided movably such that the height of the ancillary device or the wiper can be varied;
- said lateral elements are moveable in a horizontal direction to compensate for a width of the metal product.

2. The installation according to claim 1, which further comprises two supports formed as lateral pillars, disposed at sides of said tank and supporting said crossmember above said tank.

3. The installation according to claim 1, which further comprises a guide support disposed at a side of said tank and permitting said securing unit, said wiper and said ancillary device attached to said securing unit, to be retracted horizontally out of a region of said tank.

4. The installation according to claim 1, which further comprises at least one lateral support disposed at a side of said tank and placed on a floor for supporting said securing unit above said tank.

5. The installation according to claim 4, which further comprises at least two lateral supports forming a one-piece assembly with said crossmember, said crossmember coupling each said at least one lateral support.

6. The installation according to claim 4, wherein said securing unit is retractable to a side of said tank by said at least one lateral support provided movably at said side of said tank.

7. The installation according to claim 1, wherein said securing points include a removable anchor disposed between said securing unit and each said at least one ancillary device or said wiper.

8. The installation according to claim 7, wherein said removable anchor is a male/female anchor or a bearing anchor or a suspension support anchor adapted to hold each said at least one ancillary device or said wiper.

9. The installation according to claim 1, wherein said securing points are independently vertically movable.

10. The installation according to claim 1, wherein said securing points have movable 2D or 3D pivots.

11. The installation according to claim 1, wherein a position of said securing points is regulated with controlled movability governed by an operator or an automatic controller emitting control signals from a measuring device to a unit for moving said securing points.

12. The installation according to claim 9, wherein a position of said securing points is regulated with controlled movability governed by an operator or an automatic controller emitting control signals from a measuring device to a unit for moving said securing points.

13. The installation according to claim 10, wherein a position of said securing points is regulated with controlled movability governed by an operator or an automatic controller emitting control signals from a measuring device to a unit for moving said securing points.

14. The installation according to claim 1, wherein at least one lateral support disposed at a side of said tank and placed on a floor; said at least one lateral support for supporting said installation securing unit above said tank; said lateral elements of said securing unit directly supported by said at least one said lateral support above said tank, said at least one lateral support is movable; and said securing unit is retractable in a horizontal directional to a position on the side of said tank by said at least one lateral support provided movably at said side of said tank.

15. The installation according to claim 1, which further comprises an additional ancillary device including at least one of a measuring device, a hot gauge, or a spray device.

* * * * *